United States Patent [19]

Nishihara et al.

[11] 4,005,665

[45] Feb. 1, 1977

[54] METHOD FOR MAKING PRESS-WORKING BLANKS WITH REDUCED EAR OCCURRENCE

[75] Inventors: Toshiro Nishihara; Nobuyuki Takahashi; Hiroshi Katoh; Touru Ishimaru, all of Kitakyushu, Japan

[73] Assignee: Nippon Steel Corporation, Tokyo, Japan

[22] Filed: May 7, 1975

[21] Appl. No.: 575,262

[30] Foreign Application Priority Data

May 8, 1974 Japan ..... 49-51430

[52] U.S. Cl. ..... 113/116 V; 29/180 SS; 29/183.5

[51] Int. Cl.[2] ..... B21D 53/00

[58] Field of Search ..... 113/116 V, 116 W; 29/194, 183.5, 180 SS; 148/11.5 A; 72/379

[56] References Cited

UNITED STATES PATENTS 3,490,124 1/1970 Miller ..... 29/194

3,664,890 5/1972 Winter ..... 148/11.5 A

*Primary Examiner*—C.W. Lanham
*Assistant Examiner*—Gene P. Crosby
*Attorney, Agent, or Firm*—Toren, McGeady and Stanger

[57] ABSTRACT

A method for preparing a steel blank which is less susceptible to ear occurrence during its press-working into a pressed article, which comprising cutting a cold rolled steel sheet in a planar shape obtained by overlapping a circle having a diameter R and a square having a side length of about 13/14 R with their center points being at the same point and cutting the unoverlapped portions to form a blank with a periphery having alternating arcuate and straight edges. A blank is thus provided having less material due to the straight edges in those areas where large ears would otherwise occur during working.

2 Claims, 3 Drawing Figures

METHOD FOR MAKING PRESS-WORKING BLANKS WITH REDUCED EAR OCCURRENCE

BACKGROUND OF THE INVENTION

The present invention relates to a press-working steel blanks which are less susceptible to occurrence during press-work of the blanks into various cross sectional shapes, such as, round and square shapes, and a method for producing the same.

Various pressed steel articles of desired cross sectional shapes have hitherto been produced by means of a punch and a die.

However, there has been a problem of ear occurrence in the pressed articles during their press-working from sheet blanks.

The ear is a wavy projection on a pressed article caused by differences in directional properties in the sheet blanks from which it is made. This ear gets larger as the number of press-working stages increases and thus a larger ear is observed in an article obtained by a two-stage press-working than that in an article obtained by a single-stage press-working.

Hitherto now, in the field of press-working of the steel sheet blanks, the occurrence of ears has been regarded as blank unavoidable and the steel blank is prepared in a large size in anticipation of the ear occurrence. This is press-worked and then finally adjusted into a predetermined size.

This conventional preparation method of preparing steel blanks requires using excess portions of a steel sheet which are otherwise unnecessary for the blank, and thus results in a low yield obtained from the steel sheet used for blank preparation and in complicated press-working.

DESCRIPTION OF THE PRESENT INVENTION

Therefore, one of the objects of the present invention is to provide a steel blank which is less susceptible to the ear occurrence during its press-working.

Another object of the present invention is to provide a steel blank which eliminates or simplifies the necessity of the shape-adjusting step and improves the yield of steel blanks.

Still another object of the present invention is to provide a method for preparing the above mentioned steel blank.

The feature of the present invention lies in that the steel blank is prepared from a cold rolled steel sheet and has a planar shape obtained by overlapping a circle having a diameter R and a square having a side length of 13/14 R with their center points being at the same point and cutting unoverlapped portions.

The present invention will be described in more details referring to the attached drawings which show a preferred embodiment of the present invention.

DESCRIPTION OF THE PREFERRED EMBODIMENTS

Figure 2:
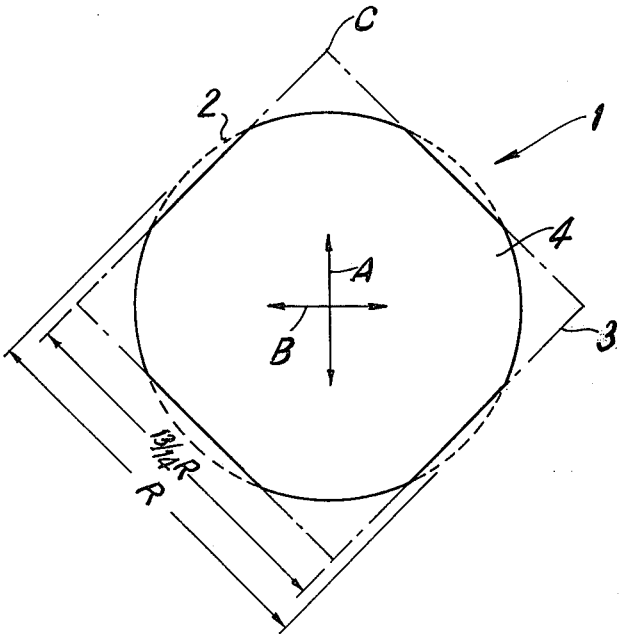
FIG. 2 is a plane view of a steel blank prepared according to the present invention.

In FIG. 2, 1 is a steel sheet, the arrow A indicates the direction of the rolling axis and the arrow B indicates the direction at right angle to the direction of the rolling axis A. 2 is a circle having a diameter R, and 3 is a square having a side length of 13/14 R.

In this case, the corner angle C is on the line passing the center point in the rolling direction A and on the line passing the center point in the direction B at right angle to the rolling direction A. 4 is a steel blank (indicated by a solid line) for press-working, having a planar shape obtained by overlapping the circle 2 and the square 3 in such a manner that they occupy the minimum dimension and cutting the unoverlapped portions.

However, it is noted that the objects of the present invention are not always attained by a steel blank having the above defined planar shape.

It has been found through experimentation that the steel blank must be made from a steel sheet which has been hot rolled and cold rolled or a steel sheet which has been further subjected to annealing and cold rolling at least one time.

Figure 1:
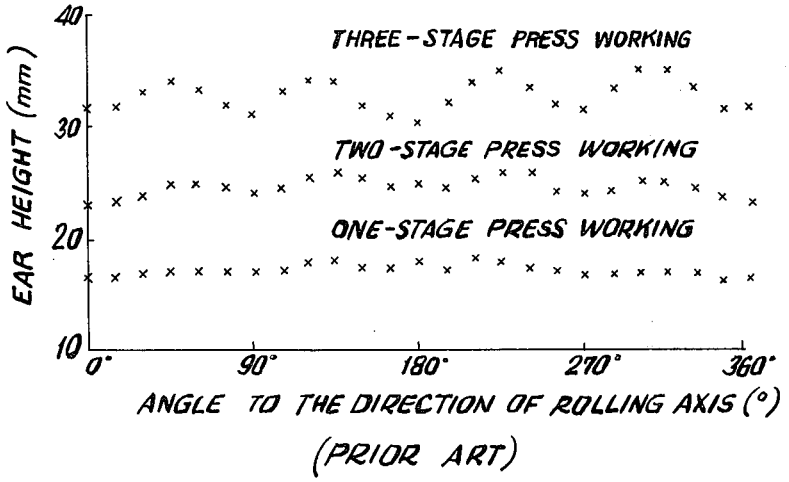
(PRIOR ART) FIG. 1
FIG. 1 is a graph showing ear heights at various angles to the rolling direction in case of press-working a conventional round blank of cold rolled steel sheet.
Figure 3:
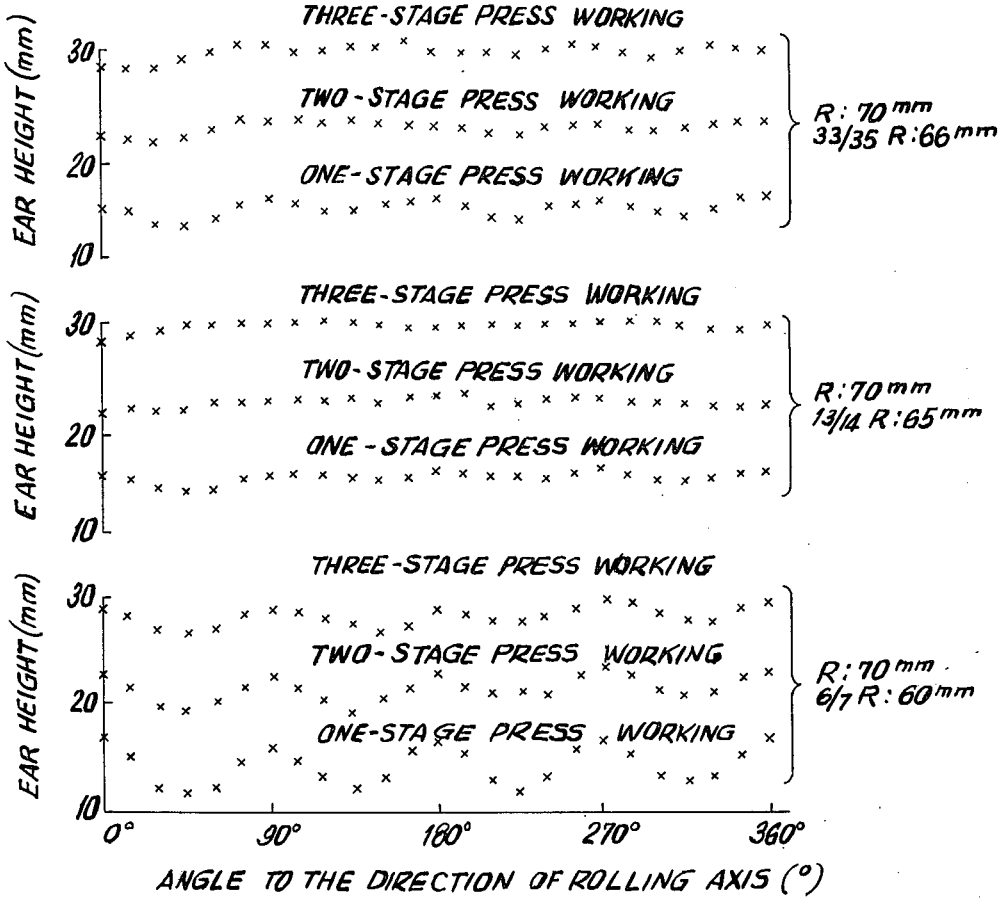
FIG. 3 shows ear heights at various angles to the rolling direction in case of press-working a steel blank according to the present invention in comparision with ear heights in steel blanks having a different ratio of the side length of the square to the diameter R of the circle.

The ear is caused depending on the degree of development of a specific structure of the steel sheet and, it has been observed that a small ear occurs in the rolling axis direction and in the direction at right angle thereto, and as shown in FIG. 1 the ear height differs at various angles to the rolling direction. By limiting the side length of the square to about 13/14 R, it is possible to obtain a pressed article with less ear occurrence as compared with the cases in which the side length of the square is 6/7 R or 33/35 R as shown in FIG. 3.

As described above, the present invention has a great advantage in that a article with less ear occurrence can be obtained even when several-stage press-working or drawings are used.

What is claimed is:

1. A method for preparing a steel blank which comprises cutting a cold rolled steel sheet in a planar shape obtained by overlapping a circle having a diameter R and a square having a side length of about 13/14 with their center points being at the same point and by cutting unoverlapped portions.

2. The method according to claim 2, in which the cold rolled steel sheet is in an annealed condition.

* * * * *